US006779750B1

(12) United States Patent
Couchey et al.

(10) Patent No.: US 6,779,750 B1
(45) Date of Patent: Aug. 24, 2004

(54) VACUUM DRAW SYSTEM FOR A YARN CARRIER START-UP GROOVE

(75) Inventors: Brian P. Couchey, Inman, SC (US); Victor J. DesRosiers, Kinderhook, NY (US); James P. Stevens, Castleton, NY (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 10/439,559

(22) Filed: May 15, 2003

(51) Int. Cl.[7] ..... B65H 67/04; B65H 19/28

(52) U.S. Cl. ..... 242/476.6; 242/125.1; 242/581; 242/172

(58) Field of Search ..... 242/476.5, 476.6, 242/125.1, 125.2, 125.3, 172, 581, 587.3, 532.2

(56) References Cited

U.S. PATENT DOCUMENTS

| | | | | | |
|---|---|---|---|---|---|
| 869,892 | A | | 11/1907 | Gay | |
| 2,017,611 | A | | 10/1935 | Stogner | |
| 2,260,452 | A | | 10/1941 | Hart | |
| 3,018,973 | A | | 1/1962 | Bradley | |
| 3,138,345 | A | | 6/1964 | Lüber | |
| 3,326,494 | A | | 6/1967 | Hartley, Jr. | |
| 3,794,260 | A | | 2/1974 | Sowell | |
| 3,856,225 | A | | 12/1974 | Wray | |
| 3,910,513 | A | | 10/1975 | Gelin et al. | |
| 3,994,058 | A | | 11/1976 | Sasaki et al. | |
| 4,057,195 | A | | 11/1977 | Jones et al. | |
| 4,063,696 | A | | 12/1977 | Kelly et al. | |
| 4,077,197 | A | | 3/1978 | Bowden et al. | |
| 4,205,800 | A | | 6/1980 | Melan et al. | |
| 4,598,880 | A | | 7/1986 | Brutel et al. | |
| 4,742,969 | A | * | 5/1988 | Masuda et al. | 242/532.2 |
| 4,832,281 | A | * | 5/1989 | Payne et al. | 242/118.3 |
| 4,842,213 | A | | 6/1989 | Bärtschi et al. | |
| 4,852,823 | A | | 8/1989 | Adams et al. | |
| 4,880,183 | A | | 11/1989 | Kubata et al. | |
| 4,901,941 | A | | 2/1990 | Powel et al. | |
| 5,178,342 | A | | 1/1993 | Romagnoli | |
| 5,343,898 | A | | 9/1994 | Fredriksson | |
| 5,403,633 | A | | 4/1995 | Jenisch | |
| 5,511,734 | A | * | 4/1996 | Enger et al. | 242/476.3 |
| 5,702,063 | A | | 12/1997 | Bottari | |
| 6,398,152 | B1 | * | 6/2002 | Burchert et al. | 242/474.7 |
| 6,487,881 | B1 | | 12/2002 | Adele | |

* cited by examiner

*Primary Examiner*—Kathy Matecki
*Assistant Examiner*—Evan Langdon
(74) *Attorney, Agent, or Firm*—Drinker Biddle & Reath LLP

(57) ABSTRACT

A carrier tube includes a vacuum draw system for promoting receipt of a yarn tail end within a circumferential start-up groove of the tube. The draw system includes angled air-scoop openings extending through the tube wall adjacent the start-up groove to move air through the tube rotation. Each of the angled openings includes a narrowed venturi portion creating a zone of reduced pressure. The system further includes passages extending between the start-up groove and the narrowed portions of the air-scoop openings to connect the start-up groove to the reduced pressure of the openings.

15 Claims, 4 Drawing Sheets

VACUUM DRAW SYSTEM FOR A YARN CARRIER START-UP GROOVE

FIELD OF THE INVENTION

The present invention relates to yarn carrier tubes supporting packages of yarn wound thereon. More particularly, the present invention relates to a yarn carrier tube having a start-up groove for receiving and capturing a yarn tail.

BACKGROUND OF THE INVENTION

Carrier tubes provide support for packages of yarn or other textile fibers. The support provided by the carrier tube facilitates handling of the yarn during processing operations such as yarn dyeing, for example. The yarn is received onto the carrier tube in a high-speed winding operation to form a yarn package on the tube.

To facilitate engagement with yarn to be wound, known yarn carrier tubes include a circumferential start-up groove formed adjacent an end of the tube. The start-up groove receives and retains a tail-end portion of the yarn. It is known to include an angled sidewall in the start-up groove to define a substantially V-shaped cross-section. Pinching of the yarn tail in the narrowed portions of the V-shaped groove facilitates capture of the yarn.

SUMMARY OF THE INVENTION

According to the present invention, a suction system for a yarn carrier tube is provided for drawing a yarn tail into a start-up groove during rotation of the carrier tube. The suction system includes air-scoop openings extending between interior and exterior surfaces of the tube. Each of the air-scoop openings includes a leading surface and a trailing surface on opposite sides of the opening with respect to a circumferential direction of tube rotation. At least a portion of the trailing surface is obliquely oriented with respect to an adjacent portion of either the interior or exterior surface of the tube such that air is moved through the air-scoop opening during rotation of the tube. The leading and trailing surfaces of each of the air-scoop openings converge towards each other to form a narrowed portion of the opening in which pressure in the moving air is reduced. The yarn tail drawing system also includes a plurality of passages each having opposite ends respectively communicating with the start-up groove and with the narrowed portion of one of the air-scoop openings to connect the start-up groove with the reduced pressure of the air-scoop opening.

According to a preferred embodiment of the invention, the start-up groove includes a first sidewall oriented substantially radially with respect to the tube and a second sidewall oriented obliquely with respect to the first sidewall to define a V-shaped cross-section. Each of the passageways of the yarn tail drawing system is connected to the first sidewall of the start-up groove and extends parallel to the second sidewall. In an alternative embodiment, the passageways include a first portion connected to the second sidewall of the groove and extending parallel to the first sidewall and a second portion connected to the first portion and extending perpendicular thereto.

According to a preferred embodiment of the invention, the trailing surface of each of the air-scoop openings is substantially planar and an outer portion of the leading surface is curved to define with the trailing surface the narrowed portion of the opening.

DETAILED DESCRIPTION OF THE DRAWINGS

Figure 1:
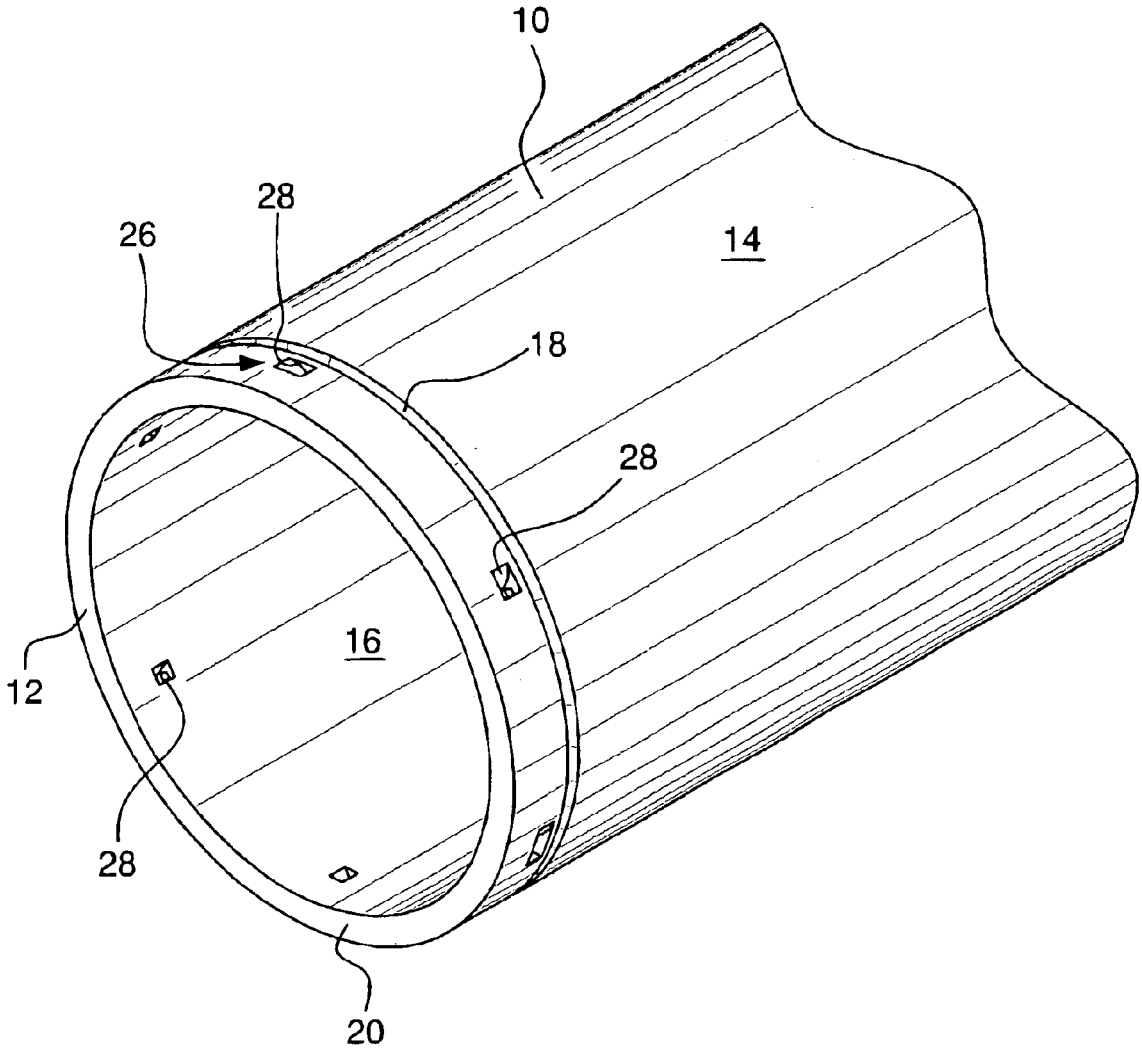
FIG. 1 is a perspective view of a portion of a yarn carrier tube having a yarn tail vaccum draw system according to the present invention.
Figure 2:
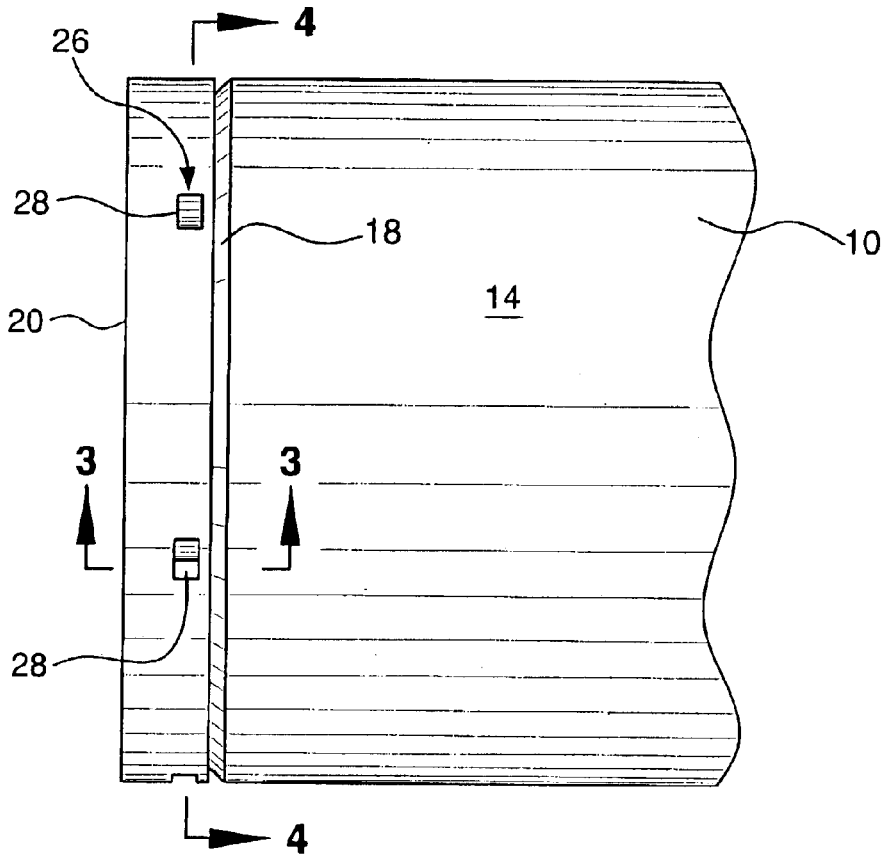
FIG. 2 is a side elevation view of the yarn carrier tube of FIG. 1.

Referring to the drawings, where like numerals identify like elements, there is shown a yarn carrier tube 10 according to the present invention. Referring to FIGS. 1 and 2, the carrier tube 10 includes a hollow cylindrical wall 12 having opposite exterior and interior surfaces 14, 16. The exterior surface 14 of wall 12 defines a winding area for receipt of yarn wound onto the carrier tube 10 to form a package. For simplicity of illustration, a central portion of the tube is shown as having a solid wall 12. It should be understood, however, that the central portion of the wall 12 could be perforated with rows of openings to provide for passage of dye through the tube 10 to facilitate contact between the dye and a yarn package in a yarn dyeing process.

The carrier tube 10 includes a start-up groove 18 extending circumferentially adjacent an end 20 of the tube. The groove 18 is sized for receiving a length of yarn, such as a tail end portion. The groove 18 is adapted for capture of the yarn tail to facilitate receipt of the yarn onto the winding area of the tube 10 in a high-speed winding operation forming a yarn package for example.

Figure 3:
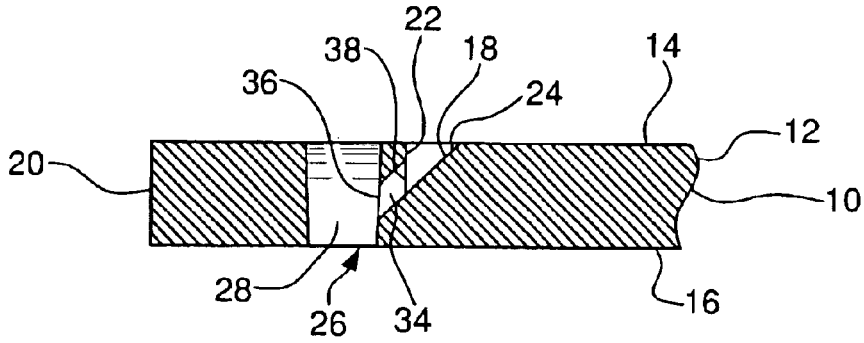
FIG. 3 is a section view taken along the lines 3—3 of FIG. 2.

As shown in FIG. 3, the start-up groove 18 includes a radially-extending surface 22 (i.e., a surface oriented substantially perpendicular to a tangent plane at the tube exterior surface 14) and an angled surface 24 (i.e., a surface obliquely oriented with respect to a surface tangent plane). The radially-extending and oblique surfaces 22, 24 define a substantially V-shaped cross section for groove 18. The narrowing of the V-shaped groove 18 adjacent its bottom end functions to pinch the received yarn providing for capture of a yarn tail by the start-up groove. The start-up groove 18 extends uniformly and continuously around the tube 10. The present invention, however, is not limited to the specific groove construction shown in the figures and could, for example, include a groove having discontinuous portions or a groove having a cross section that varies along its length.

The carrier tube 10 includes a vacuum draw system 26 for promoting receipt and capture of a yarn tail within the start-up groove 18. As will be described in greater detail, the draw system 26 utilizes air that is drawn through the cylindrical wall 12 during rotation of the tube 10 to apply a vacuum suction to the start-up groove 18. The suction tends to draw a yarn tail into the start-up groove 18 and toward the lower, narrowed, portion therein to promote pinching capture of the yarn. The vacuum draw system 26 includes air-scoop openings 28 extending through the cylindrical wall 12 adjacent the start-up groove 18 between the groove and the tube end 20. The air-scoop openings 28, however, do not extend radially through the tube wall 12 and, instead, are angled to function as air-moving vanes during rotation of the tube 10.

Figure 4:
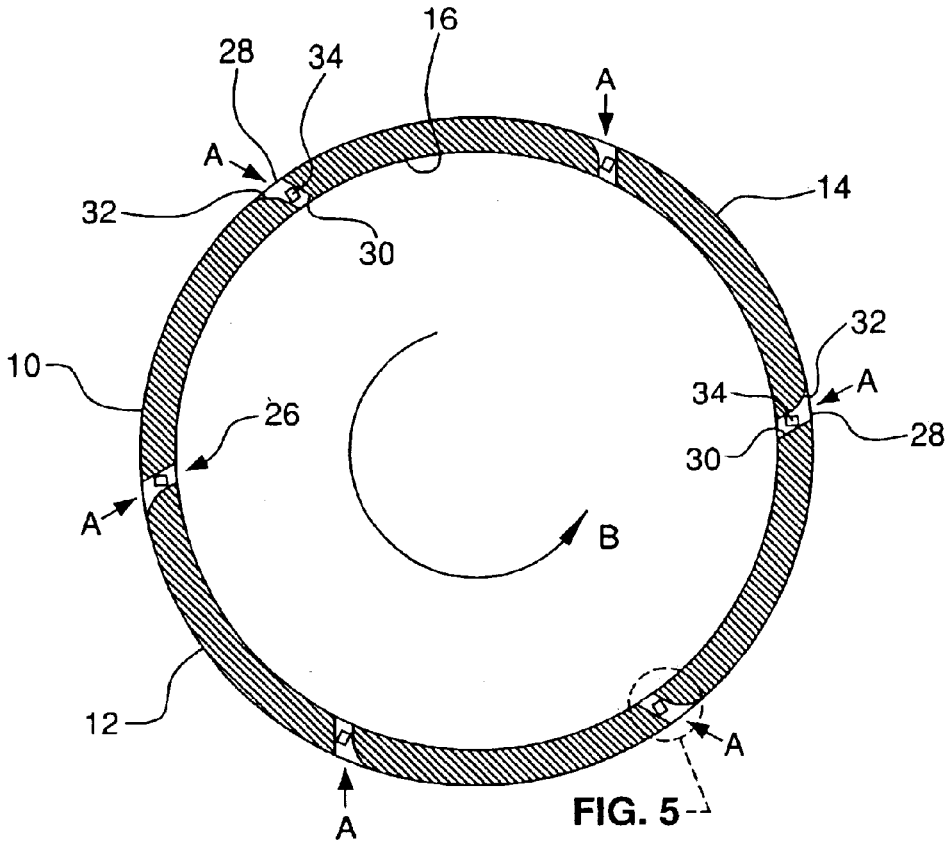
FIG. 4 is a section view taken along the lines 4—4 of FIG. 2.
Figure 5:
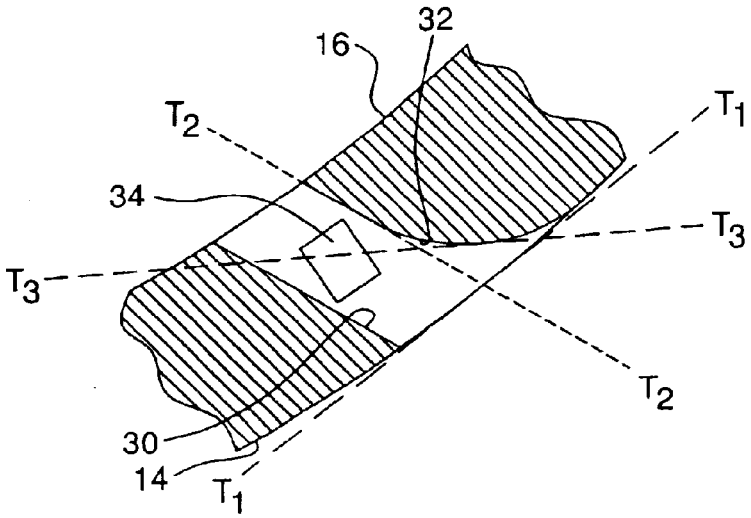
FIG. 5 is an enlarged detail of one of the air-scoop openings of the yarn carrier FIG. 4.
Figure 6:
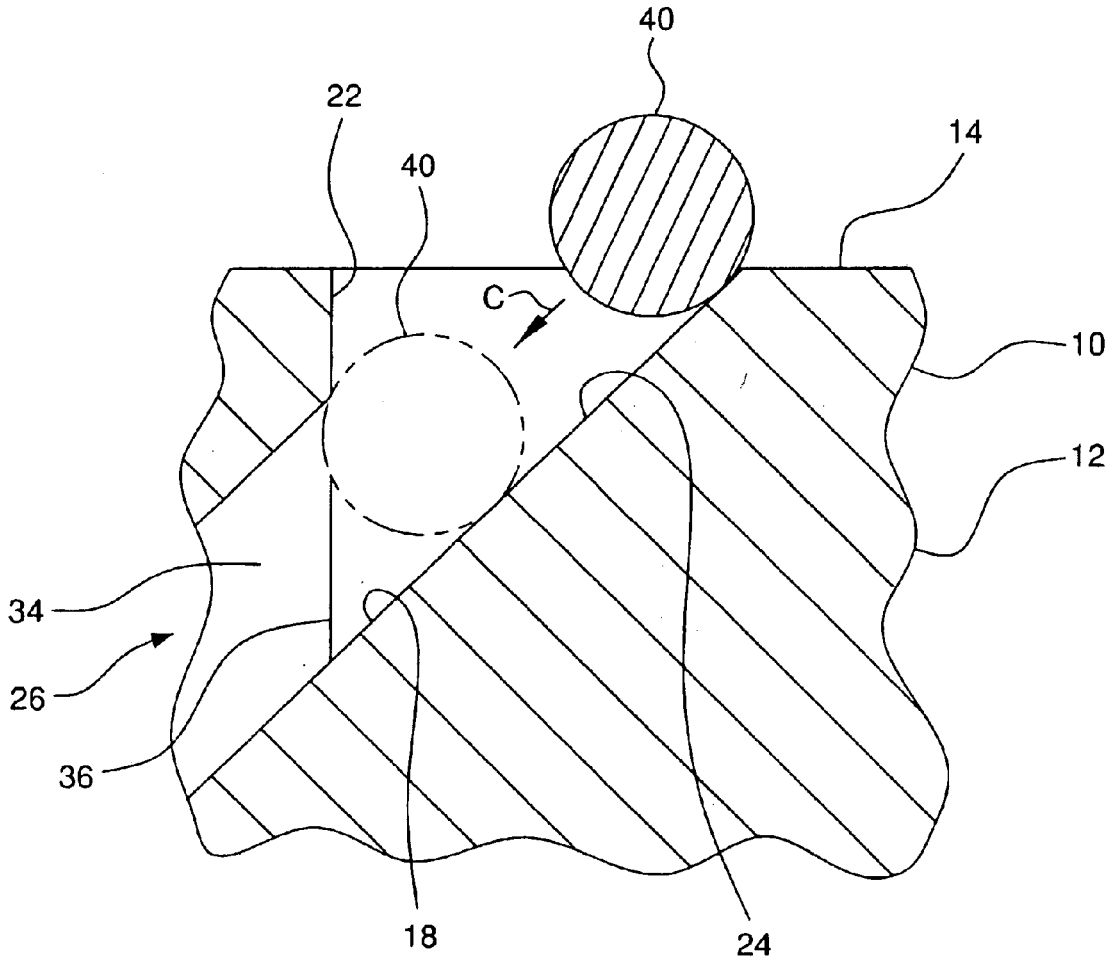
FIG. 6 is an enlarged detail view of the start-up groove of the yarn carrier tube of FIG. 1 at the location of one of the air-scoop connecting passages.

Referring to FIG. 4 and the enlarged detail view of FIG. 5, each of the air-scoop openings 28 includes surfaces 30, 32 located on opposite sides of the opening 28 with respect to the circumference of the cylindrical wall 12. The surfaces 30, 32 are trailing and leading surfaces, respectively, with respect to tube rotation in the direction shown by arrow B in FIG. 4. The trailing surface 30 is substantially planar and is angled such that it is oriented obliquely with respect to a tangent plane, $T_1$, located at the exterior surface 14 of tube 10. The leading surface 32 of the air-scoop opening 28 is a curved surface. At any location on curved surface 32, however, a tangent line (such as lines $T_2$ and $T_3$) is obliquely oriented with respect to the surface tangent plane $T_1$.

As a result of the oblique orientation of the surfaces 30, 32 with respect to the tube wall 12, the air-scoop openings 28 function as "vanes" creating a flow of air through the tube wall 12 during rotation of the tube 10. Referring to FIG. 4, rotation of tube 10 in the direction shown by arrow B results in movement of air through each of the air-scoop openings 28 in the directions shown by arrows A.

The oblique angle of leading surface 32 of the air-scoop openings 28 is greatly reduced in the outermost portion of the openings 28 with respect to the angle in the remainder of the opening 28, as shown by tangent lines $T_2$ and $T_3$ in FIG. 5. As a result, the trailing and leading surfaces 30, 32 converge from the exterior surface 14 of tube 10. In accordance with the well-known Venturi principle of fluid mechanics, the convergence of surfaces 30, 32 causes an increase in the velocity of the moving air and a reduction in pressure in the narrowed portion of the air-scoop openings 28.

Referring to the section view of FIG. 3, the vacuum draw system 26 further includes a plurality of passages 34 each having an end 36 communicating with one of the airs-coop openings 28 and an opposite end 38 communicating with the start-up groove 18. As shown in FIG. 4, end 36 of the passage 34 communicates with the narrowed portion of the air-scoop opening 28 to connect the start-up groove 18 to the zone of reduced pressure created by the Venturi effect on the air moved through the opening 28.

Referring to FIG. 5, the effect that the vacuum draw system 26 has on a yarn tail 40 is illustrated. The connection between the groove 18 and the air-scoop opening 28 provided by passage 34 creates a suction effect in the groove 18 that results as air is drawn into the passage 34, as shown by arrow C, because of the reduced pressure in the air-scoop opening 28. The suctioning effect in the start-up groove tends to direct the yarn tail 40 into the groove 18 and maintain the captured yarn tail within the groove 18. The communication between the passage 34 and the start-up groove 18 adjacent the bottom of the groove 18 desirably directs the yarn tail toward the bottom of the groove 18 thereby promoting pinching capture of the yarn tail 40 in the groove 18.

The vacuum draw system 26 shown in FIG. 1 includes six air-scoop openings 28 evenly spaced about the circumference of the yarn carrier tube 10. The present invention, however, is not limited to any particular arrangement of air-scoop openings and could, therefore, include fewer or more openings. From the point of view shown in FIG. 4, the air-scoop openings 28 of the vacuum draw system 26 are constructed to provide airflow through the tube wall 12 when the tube 10 is rotated counterclockwise as illustrated by Arrow B. The resulting airflow through the tube 10, shown by the Arrows A is from the tube exterior to the tube interior. It should be understood, however, that it is not a requirement of the present invention that the air be moved through the wall in the outside-in direction shown by Arrows A in FIG. 4. The air-scoop openings, therefore, could be constructed to provide a region of reduced pressure in response to air being moved through the tube 10 from the tube interior to the tube exterior.

Figure 7:
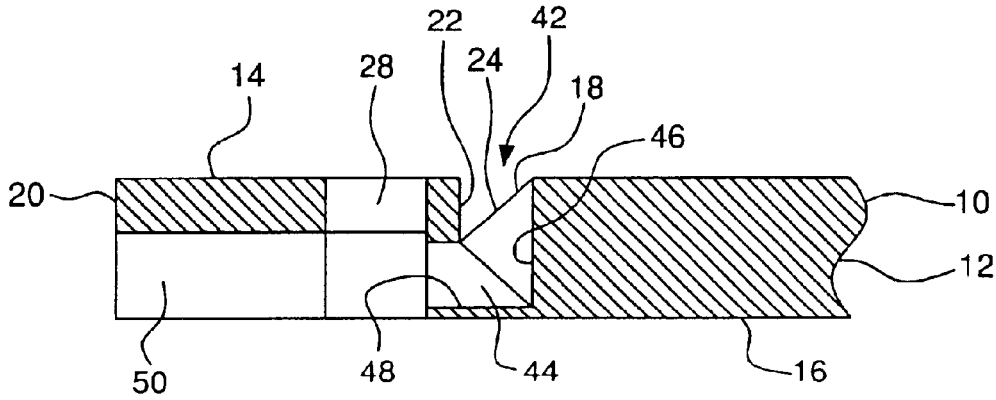
FIG. 7 is a section view showing an alternative construction for a vacuum draw system according to the present invention.

Referring to the section view shown in FIG. 7, there is shown a vacuum draw system 42 for yarn tube 10 that includes passages 44 having an alternative construction from the passages 34 of vacuum draw system 26. As shown in FIG. 3, the passages 34 of vacuum draw system 26 extend between the start-up groove 18 and the associated air-scoop opening 28 substantially parallel to the obliquely angled wall 24 of the V-shaped start-up groove 18. In the alternative passage construction of vacuum draw system 42, each of the passages 44 includes first and second segments 46, 48 that are substantially perpendicular to each other. The first segment 46 extends from the generally V-shaped groove 18 of tube 10 substantially parallel to the upstanding wall 22. The second segment 48 of passage 44 extends longitudinally, with respect to the tube 10, from the associated air-scoop opening 28 to connect with the first segment 46. A recess 50 in the interior surface 16 of tube 10 provides access to the air-scoop opening 28 to facilitate formation of the longitudinally extending second segment 48.

The tube 10 is preferably molded from a thermoplastic material. However, the present invention is not limited to application in tubes made from any particular material.

The foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A suction system for drawing a yarn tail into a start-up groove of yarn carrier tube during rotation of the tube, the suction system comprising:

a plurality of air-scoop openings extending between interior and exterior surfaces defined by the tube, each of the air-scoop openings including a leading surface and a trailing surface on opposite sides of the opening with respect to a circumferential direction of tube rotation, at least a portion of the trailing surface being obliquely oriented with respect to an adjacent portion of either the interior or exterior tube surface such that air is moved through the air-scoop opening, the leading and trailing surfaces of each air-scoop opening converging towards each other to form a narrowed portion of the opening that functions to reduce pressure in the air moving through the opening; and a plurality of passages each having opposite ends respectively communicating with the start-up groove and with the narrowed portion of one of the air-scoop openings to connect the start-up groove with the reduced pressure of the air-scoop opening.

2. The suction system according to claim 1, wherein the start-up groove includes first and second sidewalls defining a substantially V-shaped cross section and wherein each of the passageways communicates with the associated start-up groove adjacent a lower end of the groove.

3. The suction system according to claim 2, wherein the first sidewall of the start-up groove is oriented substantially radially with respect to the tube and the second sidewall is oriented obliquely with respect to the first sidewall.

4. The suction system according to claim 3, wherein each of the passageways is connected to the first sidewall of start-up groove and extends substantially parallel to the second sidewall of the start-up groove.

5. The suction system according to claim 1, wherein each of the air-scoop openings is located between the start-up groove and an end of the tube.

6. The suction system according to claim 1, wherein the trailing surface of each of the air-scoop openings is substantially planar.

7. The suction system according to claim 6, wherein at least an outer portion of the leading surface of each air-scoop opening is convexly curved to define the narrowed portion of the air-scoop opening with the planar trailing surface.

8. The suction system according to claim 1, wherein the start-up groove extends substantially continuously around a tube circumference and wherein the air-scoop openings are spaced substantially equally about the tube circumference.

9. The suction system according to 1, wherein the start-up groove includes a first sidewall oriented radially with respect to the tube and a second sidewall oriented obliquely with respect to the first sidewall to define a substantially V-shaped cross section, and wherein each of the passageways includes a first portion connected to the second sidewall of the start-up groove and extending substantially parallel to the first sidewall and a second portion connected to the first portion and extending substantially perpendicular thereto.

10. A system for drawing a yarn tail into a start-up groove of a yarn carrier tube, the system comprising:

a plurality of air-vane openings extending between interior and exterior surfaces defined by the tube, each of the air-vane openings being angled with respect to the tube such that air is moved through the openings during rotation of the tube; and a plurality of passages each having opposite ends respectively connected to the start-up groove and to one of the air-vane openings.

11. The yarn tail drawing system according to claim 10, wherein each of the air-vane openings includes a leading surface and a trailing surface on opposite sides of the opening with respect to a circumferential direction of tube rotation, and wherein the leading surface is curved to define a narrowed portion of the air-vane opening that functions to reduce pressure in the air moved through the opening, and further wherein each of the passages is connected to the associated air-vane opening adjacent the narrowed portion to connect the start-up groove with the reduced pressure.

12. The yarn tail drawing system according to claim 10, wherein the start-up groove includes a sidewall that is oriented obliquely with respect to the tube and wherein each of the passages extends substantially parallel to the sidewall of the groove.

13. The yarn tail drawing system according to claim 10, wherein each of the passages includes first and second portions extending substantially perpendicular to each other.

14. A yarn carrier for supporting packages of wound yarn, the yarn carrier comprising:

a tube having opposite ends and a cylindrical wall including opposite interior and exterior surfaces, at least a portion of the exterior surface defining a winding area for receipt of yarn during rotation of the tube in a circumferential direction, the tube including a start-up groove extending circumferentially adjacent one of the tube ends for receiving a yarn tail; and a system for drawing a yarn tail into the start-up groove including a plurality of air-scoop openings extending through the wall of the tube, each of the air-scoop openings including a leading surface and a trailing surface on opposite sides of the opening with respect to the circumferential direction of rotation, at least a portion of the trailing surface being obliquely oriented with respect to an adjacent portion of either the interior or exterior surface such that air is moved through the opening during rotation of the tube, the leading and trailing surfaces converging towards each other to form a narrowed portion of the air-scoop opening in which pressure of the air moving through the opening is reduced, the yarn tail drawing system further including a plurality of passages each having opposite ends respectively communicating with the start-up groove and with the narrowed portion of one of the air-scoop openings to connect the start-up groove with the reduced pressure of the air-scoop opening.

15. The yarn carrier according to claim 14, wherein an outer portion of the leading surface of each of the air-scoop openings is curved to define the narrowed portion of the opening.

* * * * *